United States Patent [19]

Gonzalez et al.

[11] 4,043,892

[45] Aug. 23, 1977

[54] ALUMINUM REDUCTION CELL HAVING A LATERAL ENCLOSURE SYSTEM

[75] Inventors: Juan M. Gonzalez; William V. Nichols, Jr., both of Portland, Oreg.

[73] Assignee: Reynolds Metals Company, Richmond, Va.

[21] Appl. No.: 640,811

[22] Filed: Dec. 15, 1975

[51] Int. Cl.[2] ..... C25C 3/06

[52] U.S. Cl. ..... 204/247

[58] Field of Search ..... 204/243 R, 244–247

[56] References Cited

U.S. PATENT DOCUMENTS

| | | | |
|---|---|---|---|
| 3,673,074 | 6/1972 | Hirt et al. | 204/243 R |
| 3,935,090 | 1/1976 | Petrusenko et al. | 204/243 R |
| 3,948,749 | 4/1976 | Sargent | 204/243 R |

FOREIGN PATENT DOCUMENTS

| | | | |
|---|---|---|---|
| 597,902 | 5/1960 | Canada | 204/243 R |
| 2,263,348 | 7/1974 | Germany | 204/247 |
| 276,438 | 10/1970 | U.S.S.R. | 204/247 |

*Primary Examiner*—John H. Mack
*Assistant Examiner*—D. R. Valentine
*Attorney, Agent, or Firm*—Glenn, Lyne, Gibbs and Clark

[57] ABSTRACT

The cell has a lateral enclosure constructed of alternately overlapping panels arranged to provide access selectively at each anode position of the cell.

17 Claims, 8 Drawing Figures

FIG. 1
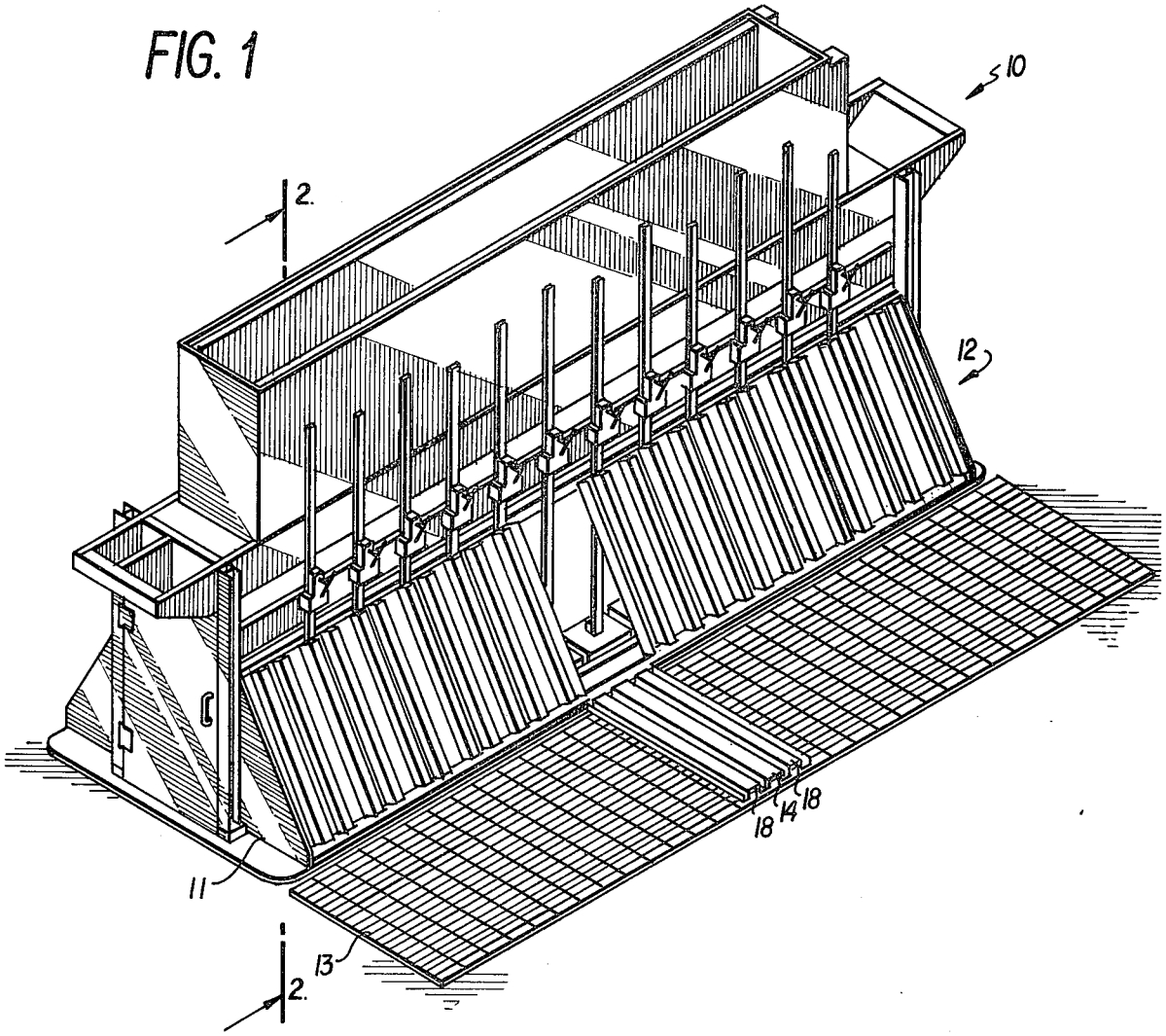
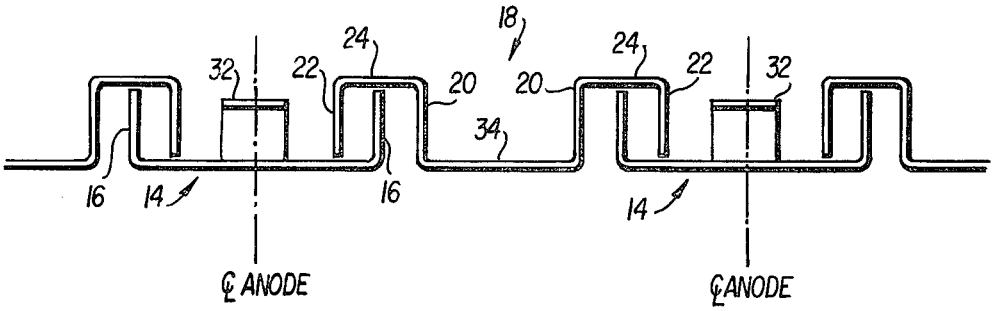
FIG. 3

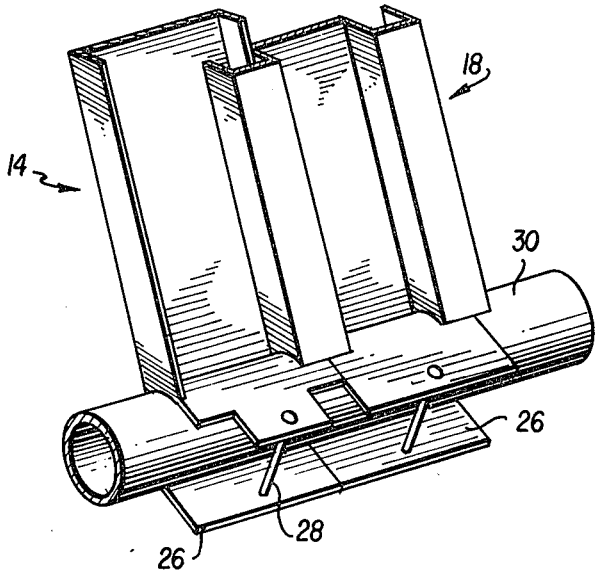
FIG. 4
FIG. 5a
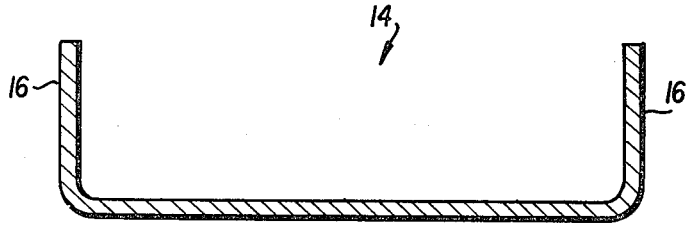
FIG. 5b
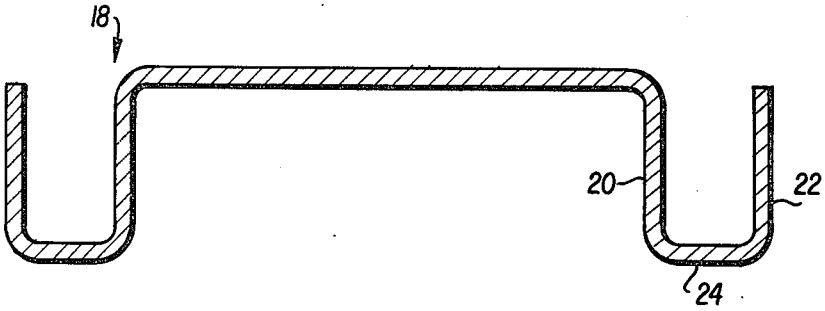
FIG. 6a
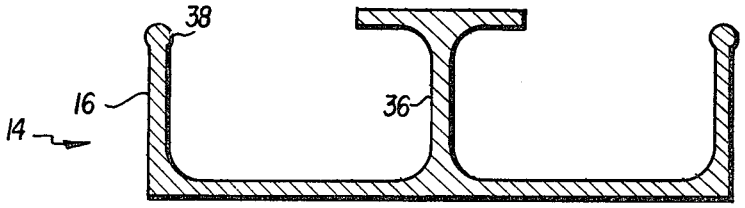
FIG. 6b
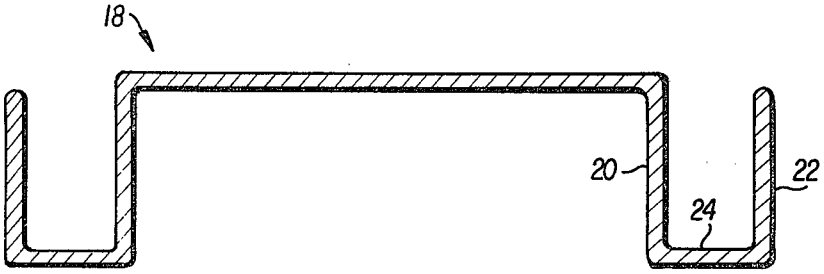

ALUMINUM REDUCTION CELL HAVING A LATERAL ENCLOSURE SYSTEM

This invention relates to a novel construction of closure panels, and it particularly concerns a panel arrangement useful in forming a lateral enclosure of aluminum reduction cells.

Such cells or pots hold a bath of molten cryolite containing dissolved alumina, and the electrodes for passing electric current through the bath typically include a carbon anode. Some cells have a continuous self-baking anode formed in an anode casing, and others have an array of prebaked carbon anodes. The invention is particularly applicable to cells of the latter type.

Operation of an aluminum reduction cell involves feeding alumina into the bath periodically, usually done by depositing alumina on a layer of crust formed over the bath and subsequently breaking in a portion of the crust. Other operating procedures include adjusting and either replenishing or replacing anodes. Prebaked anodes are replaced quite frequently, and are individually adjustable to compensate for varying ages of the anodes which are not replaced all at once.

It has become desirable for various reasons to enclose such cells as fully as possible both for heat conservation and to provide for capturing gaseous and particulate effluents. In providing lateral enclosures, attention must be given to affording suitable access for necessary pot control operations such as the procedures and practices previously mentioned. It is also desirable, of course, to minimize the extent to which these enclosures are opened, and the duration of such opening, consistent with the purposes of having an enclosure in the first place.

Thus, an objective of the present invention is to construct a lateral enclosure of a reduction cell which serves effectively for the intended purposes and offers convenient access on at least one side of the cell for carrying out various control operations.

This is accomplished in accordance with the invention by constructing the enclosure of specially designed panels which are arranged to provide access selectively at each anode position of the cell. These panels may be pivoted on a common axis at their lower ends, and are disposed in alternately overlapping relationship at their adjacent edges to form a lateral enclosure of the cell. Thus, adjacent panels have inwardly and outwardly facing opposed surfaces along their overlapping edges to achieve successively "inside-outside" and "outside-inside" arrangements. In a preferred construction the panels also have cooperating flange portions releasably interconnecting adjacent panels when they are closed.

The panels are conveniently of two types, one being a type that is referred to herein as a male panel, having laterally spaced outwardly directed flanges, and the other being a cooperating female panel having corresponding inwardly directed flange receptacles. Such male and female panels are disposed alternately in successively overlapping relationship to form an enclosure. A set of three such panels may be provided for each anode position of the cell, including an inner (or male) panel opposite the anode, with an outer (or female) panel on each side thereof. With this arrangement, access to an anode and the adjacent inter-anode spaces is afforded by opening a set of only three panels. These sets are advantageously arranged so that the inner (or male) panels of adjacent sets share a common outer (or female) panel.

BRIEF DESCRIPTION OF DRAWINGS

FIG. 1 is a perspective view of an aluminum reduction cell generally showing the arrangement of pivoted access panels forming a lateral enclosure of the cell;

FIG. 3 is a cross-sectional view through several closure panels of the cell;

FIG. 4 is a perspective view of the lower portions of adjacent panels to show how they may be arranged for rotation on a common axis;

FIGS. 5(a) and 5(b) show the cross-sectional shapes of sheet metal male and female panels, respectively, and FIGS. 6(a) and 6(b) show corresponding extruded panels.

DESCRIPTION OF PREFERRED EMBODIMENTS

Figure 2:
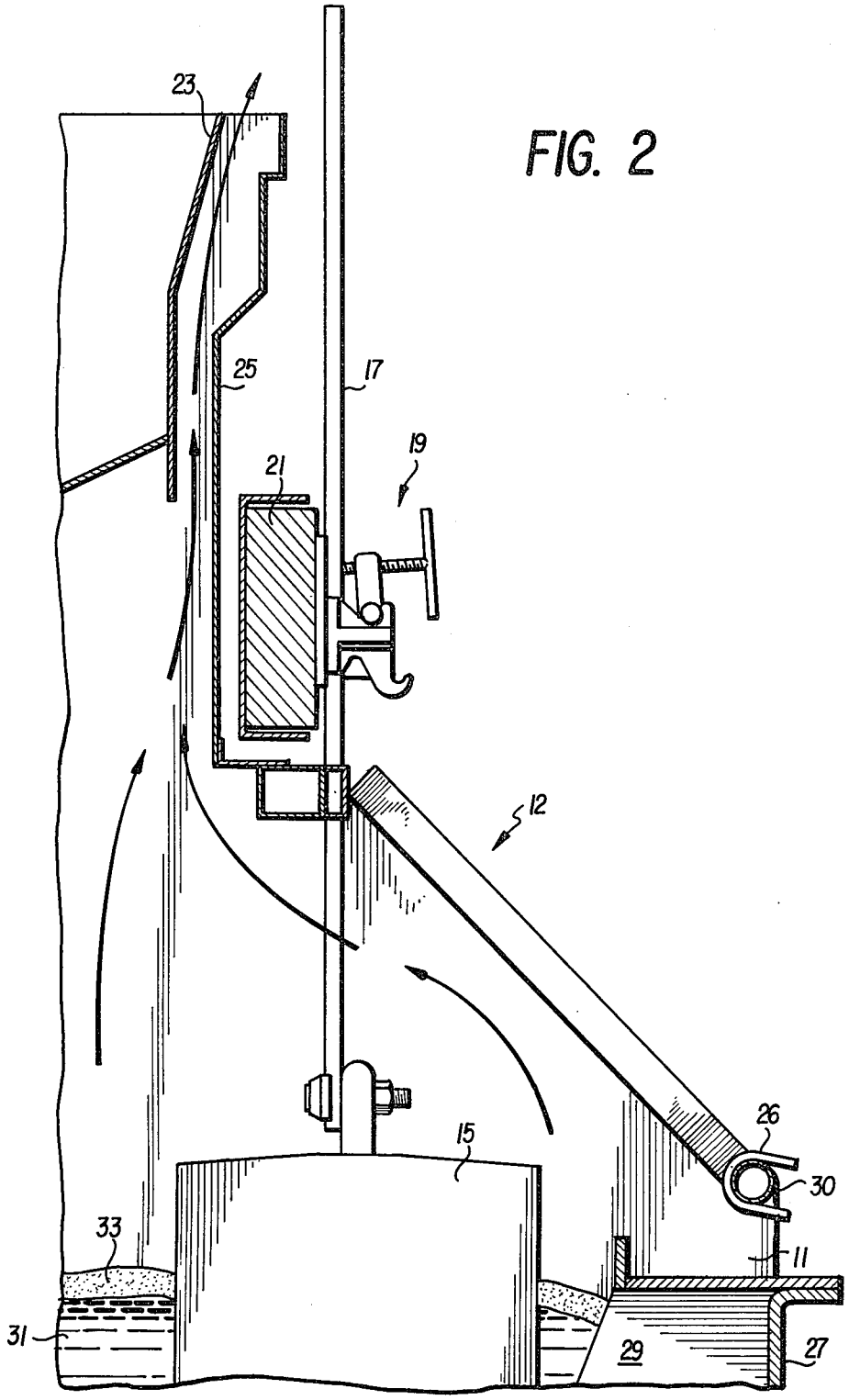
FIG. 2 is a partial transverse section along the plane II—II of FIG. 1.

As shown in FIG. 1, the reduction cell 10 has a lateral enclosure system 12 formed by a plurality of alternating male and female access panels 14 and 18, respectively, which are normally closed against a cooperating portion of the cell's superstructure. In their closed position (see also FIG. 2), these panels are generally upright but inclined inwardly over the cell somewhat, and are held in that position by their own weight. The cell enclosure is completed by a generally triangular component 11 at each end of the row of panels.

One set of three adjacent panels in FIG. 1 is shown in an open position, resting horizontally on the outer deck 13, and providing a substantially flat surface which can serve as a walkway for use by an operator working the cell. Through the opening left by this set of panels can be seen portions of the prebaked anode system of the cell.

Also shown generally in FIGS. 1 and 2 are various conventional portions of the cell, including (as indicated in FIG. 2) an anode 15, anode rod 17 and its adjusting clamp 19, the anode bus 21 and portions of an ore bin 23 incorporating an effluent exhaust conduit 25; also the pot sidewall 27, inner lining 29, the cryolitic bath 31 and overlying crust 33.

Referring next to FIG. 3, the enclosure 12 comprises alternating inner and outer panels 14 and 18, respectively, including an inner male panel 14 having an outwardly directed flange 16 along opposite sides thereof. Adjacent each male panel, and in overlapping relationship therewith, an outer female panel 18 is provided having integrally formed segments comprising an outwardly directed web portion 20 and inwardly directed web portion 22, connected by transverse base 24, and defining an inwardly open grooved flange receptacle of channel-shaped section, adapted to receive a corresponding flange 16 of the panel 14. These various flange components not only help to strengthen the panels, but are also effective cooperatively to form a substantially air-tight seal between adjacent panels when they are closed.

At the lower end of each panel (see FIG. 4) a formed hinge section 26 is welded or otherwise joined to the panel, and fastening means 28 are provided to hold these hinge sections loosely on a tubular shaft 30, allowing the panels to pivot freely on the stationary shaft.

It can also be seen in FIG. 3 that adjacent male (inner) panels 14 are arranged to share a common intermediate female (outer) panel 18, and, if desired, a handle 32 may be provided on an outer surface of the male panel. Each male panel is generally centered at an anode position of the cell, and the intermediate female panels are arranged to span the gap between anodes. Thus, access to each anode and the adjacent inter-anode spaces is afforded by opening a set of one male panel and the two adjacent female panels.

As shown in FIG. 3, each female panel has an inwardly depressed main body portion 34, or, put another way, is formed with its flange-receiving or receptacle portions 20, 22 and 24 recessed outwardly from the main body portion. This construction enables the successive male and female panels to be disposed with their major inwardly facing surfaces lying in substantially the same plane, thus providing a generally flat upper surface of adjacent panels when they are opened.

Details of individual male and female panels are shown in FIGS. 5 and 6. FIGS. 5(a) and (b) illustrate male and female panels 14 and 18, respectively, which are formed of sheet metal; and FIGS, 6(a) and (b) illustrate similar panels in the form of extruded shapes. The extruded male panel 14 of FIG. 6(a) includes a stiffening web 36 of T-shaped cross-section, as well as beaded enlargements 38 along the ends of its flanges 16. The web 36 may also serve in place of the simple bent handle 34 of FIG. 3 or a handle may be attached to the web. Using extruded shapes of this sort has the advantage of placing metal where it achieves optimum stiffness and strength of the panels while still keeping them reasonably lightweight. In like manner, the hinge portions 26 may also be made of extruded sections. Aluminum is a suitable and convenient material for making these panel and hinge components.

What is claimed is:

1. In an aluminum reduction cell having a row of individually adjustable prebaked carbon anodes, the improvement comprising:

a plurality of successively overlapping, alternating male and female access panels arranged to form a lateral enclosure along the cell, said panels being pivoted on a common axis at the lower ends thereof and adapted for being opened selectively at each anode position of the cell in sets of three adjacent panels, each such set including a male panel and a female panel on each side thereof, said male panel having laterally spaced outwardly directed flanges and the adjacent female panels having corresponding inwardly open flange receptacles.

2. The improvement of claim 1, including a set of one male and two female panels for each anode position along the cell, with the male panels of adjacent sets sharing a common intermediate female panel.

3. The improvement of claim 2 wherein each male panel of a set is centered at an anode position.

4. The improvement of claim 1 wherein the male panel of each set has an outwardly directed bent flange along each side thereof, and the adjacent overlapping female panels have an inwardly open, channel-shaped groove to receive a corresponding flange of the male panel, thereby forming a substantially air-tight seal between said panels when they are closed.

5. The improvement of claim 4 wherein said channel-shaped grooves are recessed outwardly from a main body portion of each female panel so that the inner surfaces of adjacent panels are disposed substantially in the same plane.

6. The improvement of claim 1 wherein the cell has a superstructure to support the anodes, including means against which the panels rest in an inclined position when they are closed.

7. The improvement of claim 1 wherein the pivoted panels in their fully opened position are disposed substantially horizontally.

8. The improvement of claim 1 wherein the cell has an outer deck, and the panels rest on the deck in a horizontal position when they are opened, thereby providing a walkway for an operator working on the cell.

9. In an aluminum reduction cell having individually adjustable anodes disposed in a row extending lengthwise of the cell, the improvement comprising:

a plurality of individual access panels arranged to form a lateral enclosure of the cell, said panels being disposed in alternately overlapping relationship to provide for their being selectively opened to afford access at selected anode positions of the cell, said panels comprising cooperating inwardly and outwardly directed flanges wherein opposed portions of adjacent panels cooperate along their overlapping edges to form a seal between said panels when said panels are closed.

10. The improvement of claim 9, said panels having generally planar main body portions between their flanges to provide a substantially continuous, upwardly facing flat surface when the opened panels are disposed horizontally.

11. The improvement of claim 10, said panels being formed to provide an integral outwardly directed bent flange on each side of the main body portion of alternate panels and corresponding inwardly facing flange receptacles on the adjacent intermediate panels.

12. The improvement of claim 11 wherein each of said flange receptacles comprises an inwardly open channel-shaped section of the panel recessed outwardly from its main body portion.

13. The improvement of claim 12 wherein said channel-shaped section comprises laterally spaced webs and an intermediate transverse base formed integrally with the panels main body portion.

14. The improvement of claim 13 wherein said channel-shaped section is formed of laterally spaced webs interconnected by a transverse base that is spaced outwardly from the panel's main body portion, including an outwardly directed web extending from said main body portion to said base at its inner edge and an inwardly directed web at the outer edge of said base.

15. The improvement of claim 14 wherein said inwardly directed web extends substantially to the same plane as the outwardly facing surface of said main body portion of the panel.

16. The improvement of claim 15 wherein said laterally spaced webs and their transverse base define a channel-shaped flange receptable adapted to receive a corresponding outwardly directed flange of the adjacent panel, with the main body portions of said panels lying substantially in the same plane.

17. The improvement of claim 9 wherein said overlapping edges of said adjacent panels form a substantially air-tight seal between said panels when they are closed.

* * * * *